US005353084A

United States Patent [19]

Twist et al.

[11] Patent Number: 5,353,084

[45] Date of Patent: Oct. 4, 1994

[54] CHEMICAL REACTION SYSTEMS

[75] Inventors: Peter J. Twist, Great Missenden; David M. Henson, Middlesex, both of United Kingdom

[73] Assignee: Eastman Kodak Company, Rochester, N.Y.

[21] Appl. No.: 930,669

[22] PCT Filed: Mar. 27, 1991

[86] PCT No.: PCT/EP91/00589

§ 371 Date: Oct. 2, 1992

§ 102(e) Date: Oct. 2, 1992

[87] PCT Pub. No.: WO91/15806

PCT Pub. Date: Oct. 17, 1991

[30] Foreign Application Priority Data

Apr. 2, 1990 [GB] United Kingdom ..... 9007361.0

[51] Int. Cl.[5] ..... G03D 3/08; G03D 3/02

[52] U.S. Cl. ..... 354/321; 354/324

[58] Field of Search ..... 354/324, 314–323; 134/64 P, 122 P; 430/393, 399

[56] References Cited

U.S. PATENT DOCUMENTS 2,139,224 12/1938 Douden .

3,879,203 4/1975 Schranz et al. ..... 430/393 X

FOREIGN PATENT DOCUMENTS 341637 11/1989 European Pat. Off. .

1588389 4/1970 France .

4-269745 9/1992 Japan ..... 354/324

8702150 4/1987 World Int. Prop. O. .

*Primary Examiner*—D. Rutledge

*Attorney, Agent, or Firm*—Frank Pincelli

[57] ABSTRACT

The invention provides a chemical reaction system and an apparatus exemplified by a photographic process wherein a photosensitive paper substrate is passed through a developing solution contained in a main tank and then through a replenisher tank. The replenisher tank in turn overflows back into the solution. This reduces the presence of unwanted by-products on the substrate. On leaving the replenishing solution the paper passes straight into an amplification tank, and thence into conventional bleach-fix or fixing solution.

4 Claims, 1 Drawing Sheet

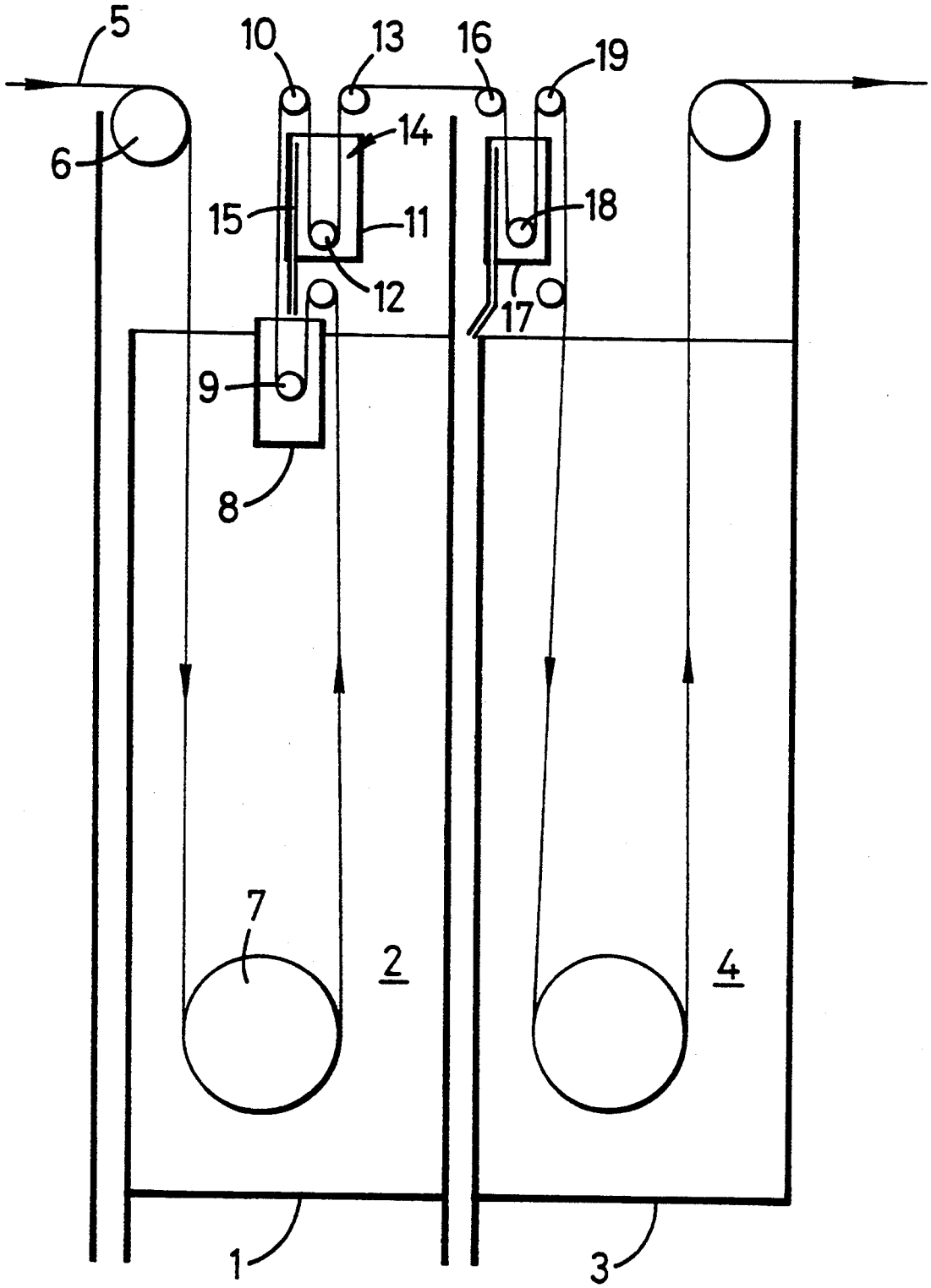
5
10
13
16
19
6
14
15
11
18
12
17
9
8
7
2
4
1
3

CHEMICAL REACTION SYSTEMS

BACKGROUND OF THE INVENTION

This invention relates to improvements in chemical reaction systems, and particularly to such chemical reaction systems when applied to photographic processes. The invention also relates to apparatus for use therewith.

It is often the case in chemical reaction systems that a chemically reactive substrate is presented sequentially to a number of different reaction sites in sequence. One of the problems with such serial reactions is carry-over of reactive materials as a result of a wetting action of the reactive substrate by the chemical reactants concerned. Another problem is that even if reactants from a first stage are mutually compatible with reactants in a second or subsequent stage, very often the by-products of reaction in one stage have a deleterious effect on reactions to follow. This problem becomes worse as the relative speed of the reactive substrate increases. This problem is particularly acute in the processing of photographic paper, but is of course equally applicable to serial treatment of textile webs for example where similar problems arise.

In our WO-A-8702150 there is described a multistage countercurrent contacting process wherein a solid is introduced sequentially to a plurality of stages and is reacted with a liquid reactant flowing in the opposed sense.

In this disclosure the depleted liquid reactant is removed from the last contacting stage for disposal or upgrading.

SUMMARY OF THE INVENTION

Accordingly the present invention provides in a first aspect a chemical reaction process comprising at least two stages through which a reactive substrate is passed sequentially, said stages containing respectively first and second reagents reactive with said substrate, wherein after passage through the first reagent and before contact with the second reagent, the substrate is contacted with a further amount of the first reagent, whereby the passage of the substrate from the first stage results in a retention of reagent by the substrate as it leaves the stage thereby depleting the first stage, and wherein a first and a second auxiliary stage are interposed between the first and second stages; said first auxiliary stage being adapted to overflow into said first stage, and the second auxiliary stage being adapted to overflow into the first auxiliary stage, and in that the substrate passes countercurrent from the first stage and sequentially through the first and said auxiliary stages, characterised in that the amount of first reagent supplied from the second auxiliary stage at least substantially equates to the depletion rate of the first reagent in the first stage. Each stage is conveniently effected in a bath. As it will be appreciated it is often the case that deleterious by-products such as halide ions are formed during reaction between the reactive substrate and the first reagent. As a continuous reaction progresses there will be a build up of such deleterious by-products which result in a higher throughput of reactants or can eventually result in the whole contents of a bath having to be discarded. Not only does this provide environmental pollution problems, but also results in comparatively high costs. It is most desirable therefore that the reactive contents of the baths should be utilized as long as possible. By causing the substrate to contact a further amount of the first reagent, unpolluted by by-products, the reactions uncompleted due to by-product interference can be completed. Further the amount of by-product can be substantially reduced by wash off and dipping effects; and by suitable arrangement of overflows the amount of first reagent removed by adherence to the substrate as it leaves the first bath can be compensated for by addition of the correct amount of further material.

The above process may be conveniently applied to a photographic development system wherein the substrate is a photographic substrate such as a photographic colour paper, and the first reagent is a photographic developer solution. The second reagent may then be a photographic amplifier solution so that the further amount of the first solution will be in the form of a replenisher solution for the first bath.

In the invention the auxiliary stages are formed of a first auxiliary stage adapted to overflow into the developer stage, and a second auxiliary stage adapted to overflow into the first auxiliary stage, whereby the substrate passes through at least two auxiliary stages countercurrent to the replenisher.

In a preferred form of this aspect of the invention the kinetics of the reaction between the first reagent and the substrate are such that the reaction is substantially completed in the first stage.

In a further aspect of the invention there is provided a photographic development apparatus comprising a developer bath, an amplifier bath, and a bleach fix or fixer bath adapted such that a photographic paper substrate path passes sequentially through said baths, characterised in that at least two replenisher baths are operatively associated with the substrate path, and in that the highest of the replenisher baths in the spacial sense overflows into the lower of said replenisher baths while the lower replenisher bath overflows into the developer bath, and in that the apparatus is adapted such that the replenishement rate at least substantially equates to the rate of depletion of the developer reagent from the first bath by the substrate.

BRIEF DESCRIPTION OF THE DRAWING

The accompanying diagrammatic drawing to which reference is now made illustrates the application of the invention in a photographic process.

DETAILED DESCRIPTION OF THE INVENTION

The apparatus generally comprises a first tank 1 containing developing solution 2 and a second tank 3 containing a bleach-fix of fixing solution 4.

A photographic substrate in this case a photographic paper coated with a low level of silver halide in gelatine, is fed into the tank 1 along a substrate path 5, initially over a roller 6 and around a lower roller 7 in the developing solution 2.

At the top of the tank 1 there is positioned a small tank 8 which contains one roller 9 over which the paper passes. From the tank 8 the paper passes over a roller 10 into a tank 11 comprising an intermediate stage for the process. The paper passes over the roller 12 in the bottom of the tank 11 and up over a roller 13. A developer-replenisher solution is fed into the tank at 14 and this has a rate of feed which is substantially equal to the loss of liquid from the developing tank 1 by virtue of carry-over of developer solution on the paper as it leaves the tank 1. Any excess liquid passes through an overflow pipe 15 into the tank 8.

The paper is fed from the roller 13 over a roller 16 into an amplification tank 17. The paper goes round a roller 18 at the bottom of the tank 17 and out over an exit roller 19 into the bleach-fix solution 4 in tank 3.

In operation the paper to be processed is fed along substrate path 5, over roller 6 into the developing solution 2 and passes from this into the tank 8 and around the roller 9. In so doing the developer, which in this example is one similar in composition to that known as Kodak RA-4, reacts with the silver halide on the paper and consumes the developing agent known as Kodak CD3 and leaches out chloride ions to form a seasoned solution. This seasoned solution is taken into an auxiliary tank 8 by carry over on the paper as it passes from the developing tank. Tank 8 comprises developing agent of the same constitution as developing solution 2 but with very little by-product therein. From tank 8 the paper passes over roller 10 into the replenisher tank 11 which is constantly filled with replenisher 14. The input of replenisher is only slightly in excess of the loss rate through the carry-over of the replenisher on the paper and the excess replenisher overflows down tube 15 into auxiliary tank 8. In auxiliary tank 8 the paper is subjected to an intermediate treatment with replenished developer. The liquid carried over into the replenishing tank 11 was thus less seasoned than that in tank 1.

The paper leaving tank 11 over rollers 13 and 16 is coated almost wholly with the replenisher and this paper is carried straight into the amplification tank 17, whereafter it passes over rollers 18 and 19 before entering the bleach-fix or fixing solution 4 in tank 3. The effect of the process is that no chloride ions were carried over into the amplifying tank 17 or were carried over in such minute quantities as to be of little effect.

As a result of the invention the rate of the addition of replenisher introduced into tank 1 was able to be controlled to a level such that it just kept the developing solution 2 topped up with a minimum or no overflow. This resulted in there being no, or very little, developer to be treated as an effluent discharge.

The following two examples show the effect of the invention:

EXAMPLE I

Three solutions consisting of a developer, a replenisher and an amplifier were prepared as described in table 1 below.

TABLE 1

| | SOLUTION COMPOSITION | | |
|---|---|---|---|
| Component | Developer | Replenisher | Amplifier |
| Anti-calcium agent | 1.2 g/l | 1.2 g/l | 1.2 g/l |
| K2CO3 | 20.0 g/l | 25.0 g/l | 20.0 g/l |
| Anti-oxidant | 2.0 ml/l | 8.0 ml/l | — |
| KBr | 7.2 mg/l | — | — |
| Kcl | 1.8 g/l | — | — |
| CD3 | 8.0 g/l | 10.8 g/l | — |
| pH | 10.3 | 10.3 | 10.0 |
| H202(30%) | — | — | 5.0 ml/l |

Samples of exposed paper were processed through three different cycles as follows:

TABLE 2

| | | | Time (Seconds) | | | |
|---|---|---|---|---|---|---|
| Cycle | Dev | Rep | Amp | Stop | Bleach-Fix | Wash |
| 1. | 30 | 0 | 5 | 30 | 45 | 180 |
| 2. | 15 | 15 | 5 | 30 | 45 | 180 |
| 3. | 0 | 30 | 5 | 30 | 45 | 180 |

Cycle 1. starts with a developer composition that would occur in a developer tank seasoned with replenisher at a replenishment rate of 3 ml/365 $cm^2$(sq.ft.) This results in the highest KCl level that would be expected. The replenisher had a composition which was necessary to replenish the developer tank at 3 ml/365 $cm^2$(sq.ft.) Dmax and Dmin values through these three process cycles are shown in Table 3 for a coating (A) which contains a total of 13.4 mg/365 $cm^2$(sq.ft) of silver.

TABLE 3

| | DENSITIES (×100) (A) | | | | | | | | |
|---|---|---|---|---|---|---|---|---|---|
| | Neutral Dmax | | | Dmin | | | Separation Dmax | | |
| Cycle | R | G | B | R | G | B | R | G | B |
| 1 | 164 | 179 | 183 | 11 | 12 | 09 | 126 | 141 | 160 |
| 2 | 184 | 206 | 211 | 11 | 13 | 09 | 160 | 235 | 200 |
| 3 | 230 | 248 | 226 | 13 | 15 | 11 | 282 | 277 | 217 |

It can be seen that with the same total processing time as in cycle 1, cycle 2 gives higher Dmax values especially in the separations. This demonstrates the principle of the invention. Cycle 2 has lower Dmax values than cycle 3 and this indicates that cycle 2 would be better if the developer time was shorter and replenisher time was longer.

In the above example the Anti-calcium agent was Kodak Anti-Cal NO5 and the anti-oxidant was Kodak BD89.

EXAMPLE II

A second example is shown in Table 4 a coating (B) which contains 20.5 mg/365 $cm^2$(sq.ft.) of silver as measured by X-ray fluorescence.

TABLE 4

| | DENSITIES (×100) (B) | | | | | | | | |
|---|---|---|---|---|---|---|---|---|---|
| | Neutral Dmax | | | Dmin | | | Separation Dmax | | |
| Cycle | R | G | B | R | G | B | R | G | B |
| 1 | 195 | 192 | 211 | 11 | 12 | 10 | 183 | 185 | 200 |
| 2 | 233 | 226 | 242 | 12 | 14 | 12 | 225 | 256 | 225 |
| 3 | 260 | 240 | 248 | 13 | 15 | 12 | 260 | 258 | 230 |

The above examples were all processed in apparatus of the construction of the FIGURE. It is possible, however, to vary this arrangement. For example, the system of multiple-application rollers could be used as the sole application method or, alternatively, the sole application system could be a U tube of a relatively small volume rather than the serial tanks are just described. In such a case the replenisher would be fed in at the exit side of the tube and there would be relatively little movement of the replenisher through the tube, although what there was would be from the exit side to the inlet side. This would mean that the concentration of replenisher would gradually increase from 100% at the exit side to a lower figure at the paper entry side.

With a U-tube of a total volume of 300 ml. a replenishment rate of the order of 15 ml/365 $cm^2$(sq.ft.) is sufficient. This ensures that there is enough path length of uncontaminated replenisher solution to be carried into the amplifying tank 17.

It can thus be seen that the process of the invention avoids problems due to the build-up of halide ions in the developing solution which would inhibit amplification. The invention uses the minimum of materials and is thus likely to cause very little environmental pollution.

The word "Kodak" is a Registered Trade Mark.

We claim:

1. A process comprising the steps of:

passing a reactive substrate sequentially through a first main bath containing a first reagent reactive with said substrate, wherein passing the substrate through the first main bath results in a retention of reagent by the substrate as it leaves the bath thereby depleting the first main bath, passing the substrate from the first main bath through a first auxiliary bath to contact the substrate with a further amount of the first reagent after passage through the first main bath and before contact with the second reagent, passing the substrate sequentially from said first auxiliary bath through a second auxiliary bath to contact the substrate with a further amount of the first reagent, said second auxiliary bath being adapted to overflow into said first auxiliary bath and said first auxiliary bath being adapted to overflow into said first main bath, with the first reagent being supplied from said second auxiliary bath in an amount generally equivalent to that depleted from the first main bath, and passing the substrate through a second main bath containing a second reagent reactive with the substrate.

2. A process according to claim 1 wherein the process is a photographic development process wherein the substrate is a photographic substrate, the first reagent is a photographic developer solution, the second reagent is a photographic amplifier solution and in that the further amount of first reagent is a replenisher solution for the developer.

3. A process according to claim 1 characterized in that the kinetics of the reaction between the first reagent and the substrate are such that the reaction is substantially completed in the first main bath.

4. A photographic development apparatus comprising a developer bath, an amplifier bath and a bleach fix or fixer bath adapted such that a photographic paper substrate path passes sequentially through said baths, at least two replenisher baths adapted such that the photographic paper substrate path also passes sequentially through said replenisher baths and in that the highest of the replenisher baths in the spacial sense overflows into the lower of said replenisher baths while the lower replenisher bath overflows into the developer bath, and in that the apparatus is adapted such that the replenishment rate substantially equates to the rate of depletion of the developer reagent from the developer bath by the substrate.

* * * * *